US006121730A

United States Patent [19]

Ukegawa et al.

[11] Patent Number: 6,121,730

[45] Date of Patent: Sep. 19, 2000

[54] METAL HYDRIDES LAMP AND FILL FOR THE SAME

[75] Inventors: Shin Ukegawa, Wellesley, Mass.; Alan C. Gallagher, Louisville, Colo.

[73] Assignees: Matsushita Electric Works R&D Laboratory, Inc., Woburn, Mass.; The United States of America as represented by the Secretary of Commerce, Washington, D.C.

[21] Appl. No.: 09/090,863

[22] Filed: Jun. 5, 1998

[51] Int. Cl.[7] ..... H01J 31/00

[52] U.S. Cl. ..... 313/638; 313/637; 313/567

[58] Field of Search ..... 313/638, 637, 313/567, 639, 640, 641, 568, 569, 570, 571, 572, 573, 574, 575, 576, 577

[56] References Cited

U.S. PATENT DOCUMENTS

| | | | |
|---|---|---|---|
| 3,867,665 | 2/1975 | Furmidge et al. . | |
| 4,427,922 | 1/1984 | Proud et al. . | |
| 4,745,335 | 5/1988 | Ohyama et al. . | |
| 4,924,146 | 5/1990 | Meeuwssen . | |
| 4,963,792 | 10/1990 | Parker | 315/58 |
| 5,212,424 | 5/1993 | Russell et al. | 313/562 |
| 5,327,042 | 7/1994 | Bazin et al. | 313/25 |
| 5,343,114 | 8/1994 | Bendeking et al. | 313/485 |
| 5,367,226 | 11/1994 | Ukegawa et al. . | |
| 5,451,838 | 9/1995 | Kawai . | |
| 5,479,072 | 12/1995 | Dakin et al. . | |
| 5,519,285 | 5/1996 | Ukegawa et al. . | |
| 5,661,365 | 8/1997 | Turner . | |
| 5,698,948 | 12/1997 | Caruso . | |

FOREIGN PATENT DOCUMENTS

| | | |
|---|---|---|
| 7-183007 | 7/1995 | Japan . |
| 8-148125 | 6/1996 | Japan . |
| 9-115488 | 5/1997 | Japan . |

OTHER PUBLICATIONS

"Emission of Mg–Xe Discharge and the MgXe Excimer Band", L. Schumann et al.; J.Chem. Phys. 72 (11), Jun. 1, 1980, American Institute of Physics, pp. 6081–6084.

Molecular Spectra and Molecular Structure, G. Herzberg; Van Nostrand Reinhold Company, New York, p. 548.

The indentification of Molecular Spectra, Pearse et al., Champman & Hall Ltd., London 1965, pp. 200–201.

*Primary Examiner*—Vip Patel
*Assistant Examiner*—Matthew J. Gerike
*Attorney, Agent, or Firm*—Greenblum & Bernstein, P.L.C.

[57] ABSTRACT

The present invention is directed to a metal hydrides lamp and a fill for such a lamp. The lamp chamber includes a fill of at least one metal, a buffer gas, and hydrogen and/or deuterium. When energy is provided to the fill, metal combines with the hydrogen and/or deuterium to form a molecule at an excited energy level which emits visible light when the molecule moves to a ground state energy level. The lamp may be an electrode lamp, an electrodeless lamp, a microwave lamp, or any other power source capable of imparting energy into a fill contained within a lamp chamber.

24 Claims, 6 Drawing Sheets

METAL HYDRIDES LAMP AND FILL FOR THE SAME

BACKGROUND OF THE INVENTION

1. Field of the Invention

The present invention relates to a metal hydrides discharge lamp. More specifically, the present invention is directed towards a discharge lamp having a chamber filled with metal, hydrogen or deuterium, and a buffer gas.

2. Description of the Prior Art

High intensity discharge lamps, such as high pressure sodium lamps and metal halide lamps, are well known. These lamps have a light transmissive, hermetically sealed, discharge chamber or tube; the chamber generally has the shape of a pillbox or slightly flatted sphere. The material inside the chamber (the "fill") includes a suitable inert buffer gas and one or more ionizable metals or metal halides.

In a typical lamp, an electric potential is developed between two electrodes in the lamp chamber, which provides energy to the fill in the chamber. In more recent years, a new type of "electrodeless" lamp has been developed, in which an external capacitive or inductive element, such as a coil, is placed in proximity to the chamber. An electromagnetic field generated by passing electricity through the external element provides energy to the fill in the chamber to promote light emission from the fill.

Various standard performance indicators are used to rate different lamps. These factors include luminous efficacy of the lamps, its rated life, lumen maintenance, chromaticity, and color rendering index (CRI). These factors are dependent upon the fill for a particular lamp, which are generally designed to optimize the efficacy and CRI. However, it is believed that these factors can be improved upon, both individually and collectively.

SUMMARY OF THE INVENTION

It is accordingly an object of the present invention to overcome the drawbacks of the prior art.

It is accordingly a further object of the present invention to provide a fill for a lamp that produces visible light from radiation emitted by metal hydrides or metal deuterides.

According to an embodiment of the invention, there is provided a fill adapted to produce light when energy is imparted thereto. The fill includes at least one metal, at least one of hydrogen and deuterium, and at least one buffer gas having a density less than or equal to $1.0\times10^{19}$ atoms/cm$^3$.

According to a feature of the above embodiment, the at least one metal includes an alkaline metal, preferably at least one of magnesium, calcium, barium, and strontium.

According to another feature of the above embodiment, the at least one metal additionally includes at least one of sodium, lithium, indium, cadmium, and mercury.

According to yet another feature of the above embodiment, the at least one buffer gas is at least one noble gas, preferably at least one of xenon and argon.

According to a further feature of the above embodiment, a ratio of a pressure of the at least one of hydrogen and deuterium to a total pressure of the at least one of hydrogen and deuterium and the at least one buffer gas is between 5–20% at 25° C.

According to a still further feature of the above embodiment, the at least one metal is present in an amount sufficient to create a vapor density in the fill between $10_{14}$ and $10_{16}$ atoms/cm$^3$ when vaporized, preferably approximately $10_{15}$ atoms/cm$^3$.

According to another embodiment of the invention, there is provided a lamp including a sealed chamber. At least a portion of the chamber has a light transmissive surface. A fill is provided in the chamber. The fill includes at least one metal, at least one of hydrogen and deuterium, and at least one buffer gas having a density of less than or equal to $1.0\times10_{19}$ atoms/cm$^3$.

According to a feature of the above embodiment, at least a portion of the chamber is made of sapphire, ceramic, or quartz and a protective layer which isolates the at least one metal from the quartz.

According to another feature of the above embodiment, a device transmits energy to the fill.

According to yet another feature of the above embodiment, a power source connected to the device provides steady state power or near steady state power.

According to a further feature of the above embodiment, the device is a coil in proximity to the chamber, which generates an electromagnetic field sufficient to facilitate discharge of the fill when oscillating electricity is passed through the coil. The coil is preferably made of one of at least one of silver, copper, and aluminum.

According to a still further feature of the above embodiment, the device includes first and second electrodes mounted in the chamber.

According to yet still a further feature of the above embodiment, the at least one metal includes an alkaline metal, preferably at least one of magnesium, calcium, barium, and strontium.

According to another feature of the above embodiment, a ratio of a pressure of the at least one of hydrogen and deuterium to the total gas pressure in the chamber is between 5–20% at 25° C.

According to yet another feature of the above embodiment, the at least one metal is present in an amount sufficient to create a vapor density of between $10_{14}$ and $10_{16}$ atoms/cm$^3$ in the chamber when the metal is vaporized, preferably approximately $10_{15}$ atoms/cm$^3$ when the at least one metal is vaporized.

According to a further feature of the above embodiment, a total pressure in the chamber at approximately 25° C. is approximately 2.0 Torr, and a pressure of the at least one of hydrogen and deuterium is approximately 0.2 Torr.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The present invention is based upon the observation that metal hydrides (molecules of metal and hydrogen) provide an excellent material for a lamp fill. Many metal hydrides will emit light within the visible spectrum. The hydrides have a relatively high disassociation energy (e.g., 2.4 eV for magnesium hydride), and are thus quite stable. Further, hydrides tend to remain at the ground and the strongly rotating $A^2\Pi$ excited state, such that there is little waste heat energy produced as a result of higher energy levels. Hydrides also have many rotational levels, which minimize radiation trapping of emitted light. All of these factors contribute to the efficacy of fills utilizing hydrides.

Figure 1:
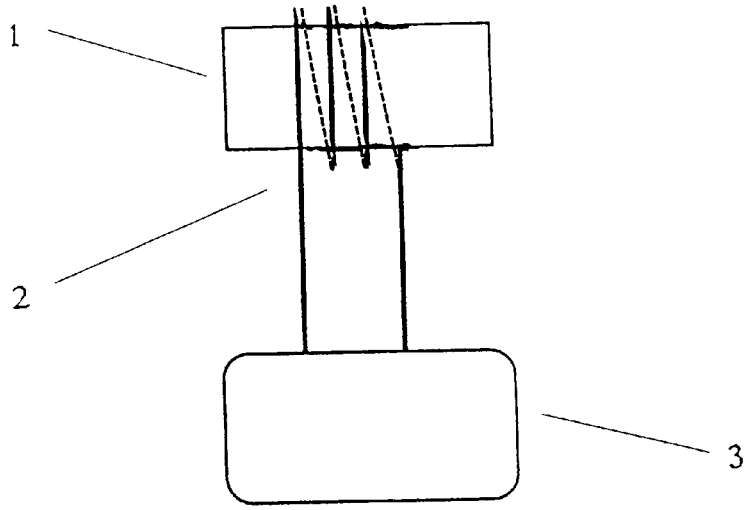
FIG. 1 is a schematic illustration of a preferred embodiment of the invention.

A preferred embodiment of the present invention in conjunction with an electrodeless lamp is shown in FIG. 1. The lamp includes a light transmissive discharge chamber 1, an inductive coil 2, and a power supply 3. In the preferred embodiment, the chamber fill includes solid magnesium (the metal), hydrogen, and argon (the buffer gas). Power supply 3 preferably provides an AC current of 13.56 MHZ, and between 10 W and 150 W of input power. A water or air cooler may be provided to cool coil 2 to counteract the effect of temperature changes in chamber 1. In this case, thermal insulation between coil 2 and chamber 1 is needed.

In the above example, chamber 1 has a 22 mm inner diameter and is 25 mm long. To provide a vapor density of magnesium of $10_{15}$ atoms/cm$^3$, the fill includes approximately 1 mg of solid magnesium. At 25° C., the amount of hydrogen gas in chamber 1 creates a pressure of 0.2 Torr, and the amount of argon creates a pressure of 1.8 Torr.

When power flows through coil 2, an electromagnetic field is produced in the region chamber 1. Free electrons in the fill (i.e., electrons that have separated from the argon and hydrogen due to ambient energy) accelerate as a result of the energy in the electromagnetic field. These electrons collide with the argon atoms and $H_2$ molecules, ionizing them to release more electrons; the repetitive effect causes the number of electrons to increase geometrically over a short period of time, an effect otherwise known as an "avalanche." This ionization raises the temperature inside chamber 1 to more than 500° C., vaporizing the solid magnesium. Since gaseous magnesium has a lower ionization energy than the argon (approximately 7.6 eV for magnesium compared with 13.4 eV for H, 15.4 eV for $H_2$, and 15.8 eV for argon), the magnesium becomes the main source of electrons.

The magnesium atoms combine with the hydrogen ($H_2$) gas and additional energy from other electrons to produce excited A state magnesium hydride (MgH*). The excited A state magnesium hydride molecules spontaneously release their excitation to reach the lower energy X state. The energy is released as visible light.

The above can be shown chemically as follows:

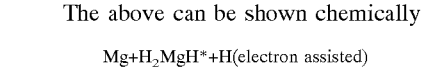

$$Mg+H_2 MgH^*+H(\text{electron assisted})$$

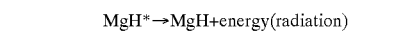

$$MgH^* \rightarrow MgH+\text{energy(radiation)}$$

Three energy sources contribute to the spectrum of the resulting visible light: the electronic energy from the difference between the A and X state energy levels, vibrational energy (v' and v" in FIG. 3) and rotational energy levels associated with each vibrational energy level.

Figure 3:
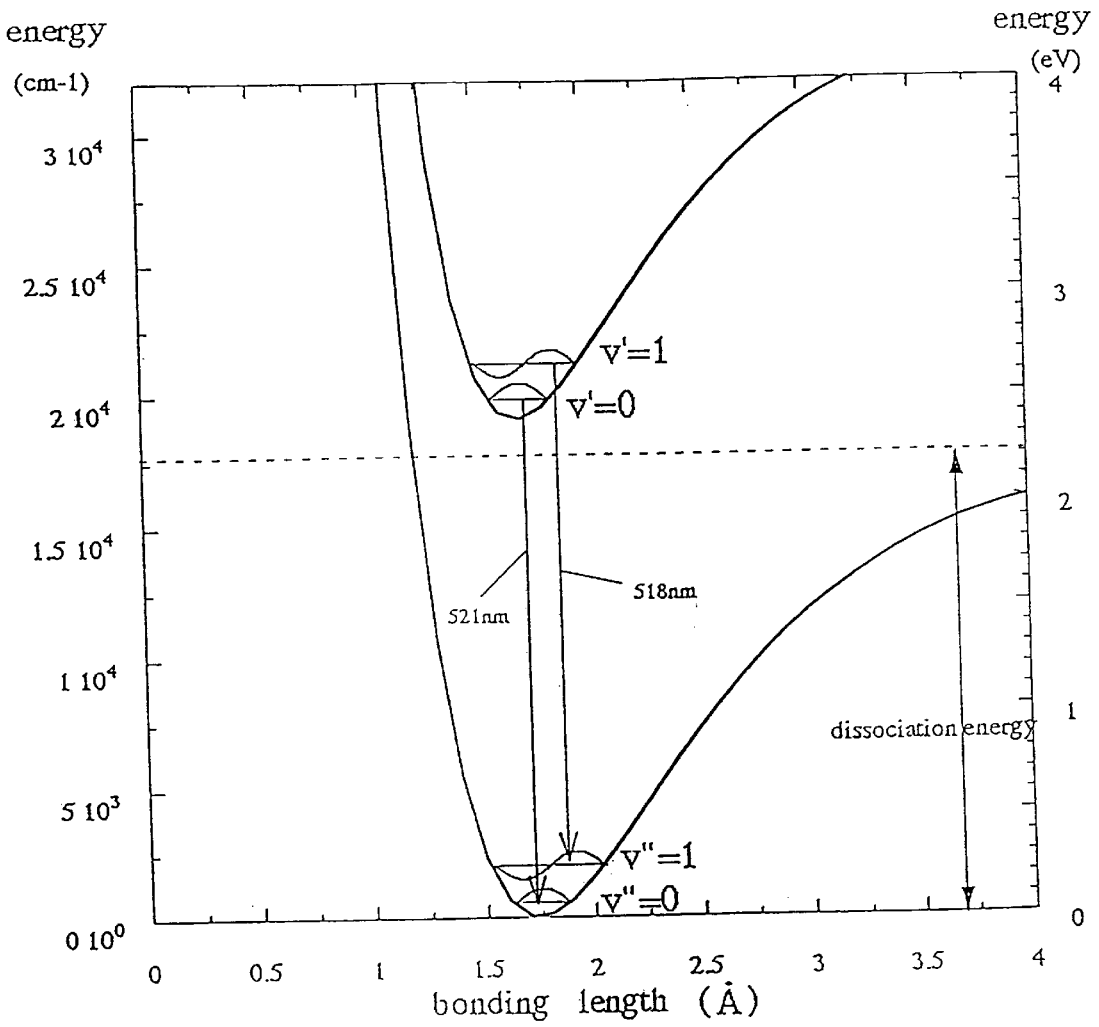
FIG. 3 is a diagram of the lower energy states of an MgH molecule.

For example, the energy diagram for magnesium hydride is shown in FIG. 3. The solid curves represent the resonance energy levels for a magnesium hydride molecule. A MgH atom in an excited v'=0 state has approximately 2.4 eV, which produces florescence at approximately 520 nm when the molecule moves to the v"=0 lower energy state. Vibrational energy also produces light in adjacent wavelength bands, which form peaks at approximately 480 nm and 560 nm (best seen in FIG. 4A). Similarly, movement from the rotational levels produces light with varying wavelengths, which tends to widen the overall wavelength bands of the emitted light in the peak areas.

Figure 4A:
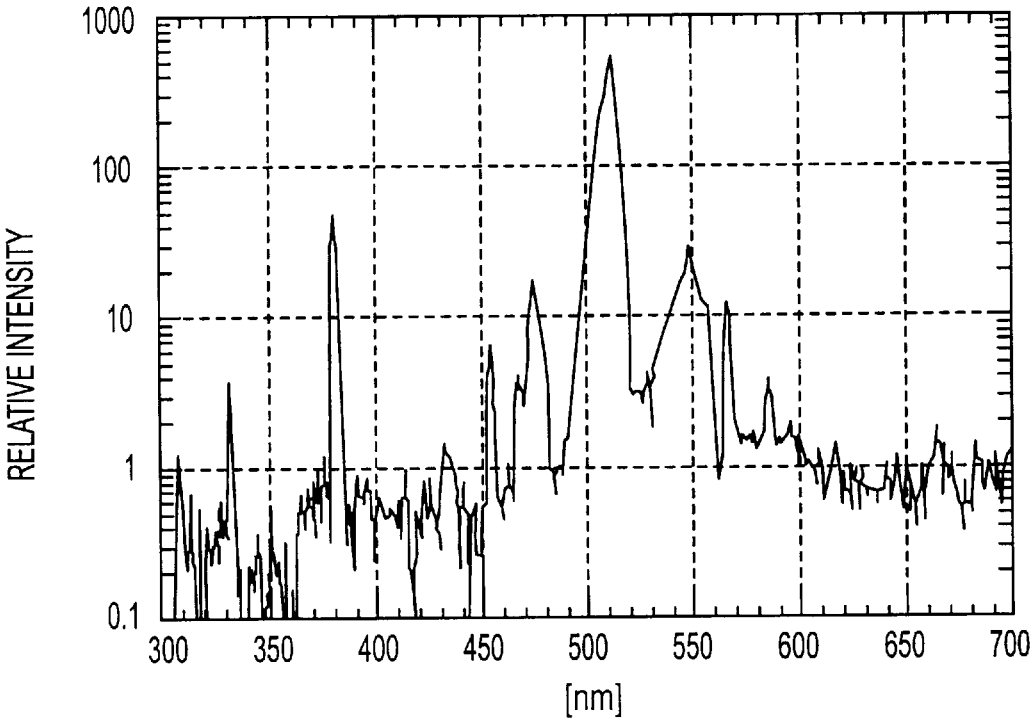
FIG. 4A is a logarithmic graph of the intensity of light at various frequencies produced by the lamp. The bands at 480, 520, and 560 nm are primarily due to an MgH molecule moving from an excited state to a lower electronic state.
Figure 4B:
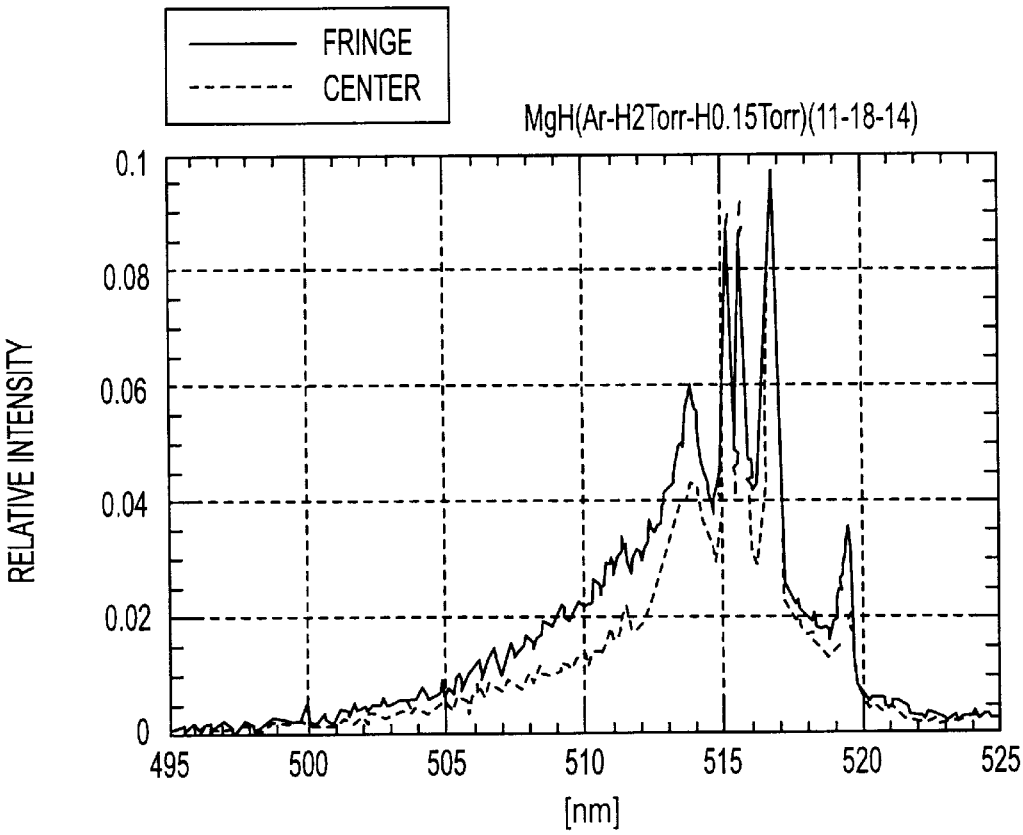
FIG. 4B is a graph of the intensity of light at various frequencies around 520 nm produced by an MgH lamp.

FIGS. 4A and 4B show logarithmic and absolute values of the relative intensity of the emitted light, which is green in color for a fill containing magnesium hydride. In FIG. 4A, the transition of the magnesium hydride from A(v'=0) state to X(v"=0) and A(v'=1) to X(v"=1) produces the main peak at approximately 520 nm. The A(v'=1) to X(v"=0) and A(v'=0) to X(v'=1) transitions produces the secondary peaks at approximately 480 nm and 560 nm. Rotational energy widens the bands, as well as to produce a "triple" peaked band best seen in FIG. 4B.

Using the fill as described above, the resulting energy efficiency is approximately 10.4%. The lamp spectrum peaks at the peak of the eye sensitivity, which represents about 90 lm/W.

Figure 6:
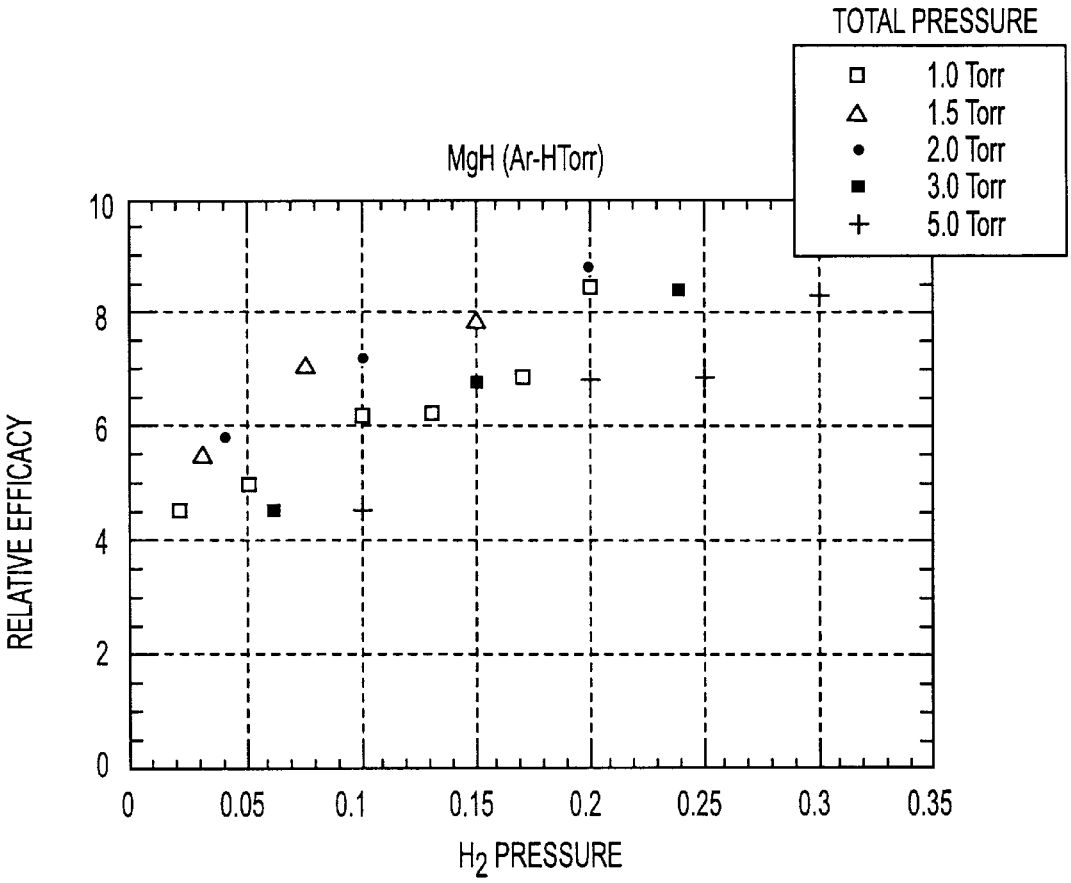
FIG. 6 is a graph of the efficacy produced by different combinations of hydrogen pressure to total pressure in the lamp fill.

FIG. 6 shows data for the relative efficacy resulting from fills with varying ratios of hydrogen pressure to total pressure (from the hydrogen and buffer gas in the fill) at 25° C. As can be seen in FIG. 6, a ratio of 0.2 Torr hydrogen to a total pressure of 2.0 Torr (i.e., 1.8 Torr argon) produced the highest efficacy. However, ratios of hydrogen pressure to total pressure in the range of 5–20% produced similar results, although other higher or slightly lower ratios may also be effective. Preferably, the pressure of the buffer gas should be below 300 Torr (approximately $1.0\times10_{19}$ atoms/cm$^3$), and more specifically less than 100 Torr (approximately $3\times10_{18}$ atoms/cm$^3$).

Accordingly to another embodiment of the invention, deuterium ($D_2$) gas is used in the fill rather than hydrogen. As in the previous embodiment, the application of an electric field to the fill vaporizes the magnesium and facilities the following chemical reactions:

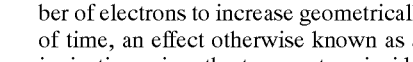

$$Mg+D_2 \rightarrow MgD^*+D(\text{electron assisted})$$

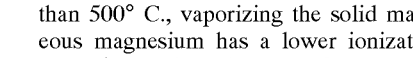

$$MgD^* \rightarrow MgD+\text{energy(radiation)}$$

Figure 5:
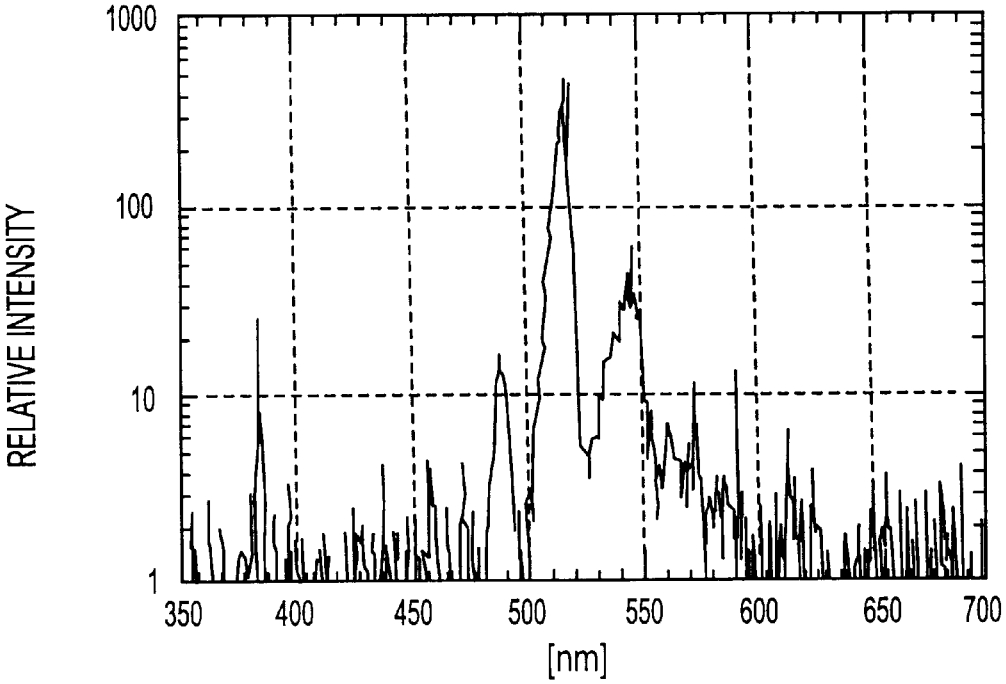
FIG. 5 is a logarithmic graph of the intensity of light at various frequencies produced by an MgD lamp. The bands at 480, 520, and 560 nm are primarily due to an MgD molecule moving from an excited state to a lower electronic state.

The resultant visible energy, produced by both the principal movement between energy states in combination with vibrational and rotational energy, has a relative intensity shown in FIG. 5. The efficacy for this fill is similar to a hydrides lamp of corresponding pressures, although there may be some effect on efficacy due to different thermal losses.

In an example of a deuterium based fill, a combination of 1 mg magnesium, 0.4 Torr deuterium and a total pressure of 2 Torr produced an energy efficiency of approximately 12.5%.

In the above embodiments, magnesium is used as the metal in the fill. However, other metals, preferably alkaline metals, may be used. By way of non-limiting example, calcium, barium, and strontium, all of which produce red and blue light, could be used, either individually or in various combinations (including combinations with magnesium). Color characteristics of the light may further be adjusted by adding solid sodium (orange light), lithium (red light), or mercury, indium or cadmium (blue light).

Regardless of the particular metal (or combination of metals) selected, the amount of solid metal should be sufficient to create a vapor density of between $10_{14}$ and $10_{16}$ atoms/cm$^3$, and preferably approximately $10_{15}$ atoms/cm$^3$. If too little metal is used (and the resultant vapor density too low), the probability of sufficient collisions between the metal atoms and the hydrogen is too low to produce any appreciable light. If the metal density is to high, the efficacy decreases due to decreasing electron temperature (too high electron density).

In the embodiments above, hydrogen or deuterium gas is used. However, these two may be used in combination, i.e., the fill may include metal(s), a buffer gas, hydrogen and deuterium. In this case, best result are obtained using a combined pressure of the hydrogen and deuterium within 5–20% of the total pressure in chamber 1, although other higher or slightly lower pressure may be used; preferably the total amount of hydrogen and deuterium should be at least $10_{14}$ atoms/cm$^{3.}$ The chamber 1 above is preferably made of $Al_2O_3$ (sapphire) to prevent degradation from the metal. However, any material that does not react with the metal can be used. For example, ceramic or ceramic coated glass or quartz, such as $Y_2O_3$, MgO, $ZrO_2$, $ThO_2$, BeO, $MgAlO_4$, $AL_6Si_2O_{13}$, $Al_{10}Y_6O_{24}$ or AlN, or a combination of these materials, may be used. A ceramic material, such as $Si_3N_4$ or BN, may also be used in conjunction with a protective layer that prevents the metal(s) in the fill from degrading the quartz; chemical vapor deposition using a gas mixture of $SiH_4$—Ar and $NH_3$ can be used to form such a protective layer.

To withstand the high temperatures generated in chamber 1, and to provide a high surface electrical conductivity, coil 2 is preferable made of silver. However, copper protected from oxidation by encapsulation in a lamp envelope or a protective insulating layer could be used. Cooled copper or aluminum, air or water cooled either through a separate cooling system or the coil through which the coolant is passed, may also be used. A silver coating encapsulated on copper to prevent oxidation thereof is also acceptable.

Figure 2:
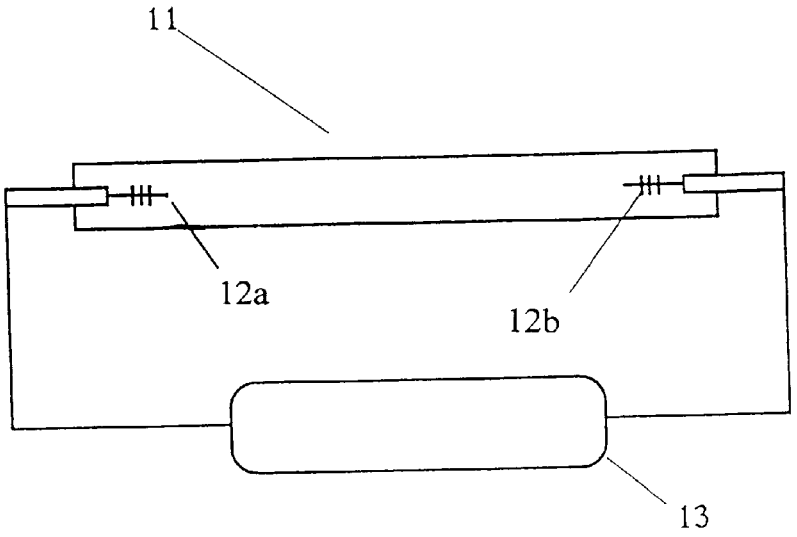
FIG. 2 is a schematic illustration of another embodiment of the invention.

A third embodiment of the present invention as utilized in a standard electrode lamp is shown in FIG. 2. A light transmissive chamber 11 has first and second electrodes 12*a* and 12*b* therein, which are connected to a power supply 13. Both electrodes 12*a* and 12*b* are preferably made of tungsten. The size of chamber 11 in this embodiment, which is dependent upon the input power (in this case 150W), is 65 mm between electrodes and 5 mm in diameter. The fill inside chamber 11 includes 1 mg of magnesium, 8 Torr of hydrogen gas, and 100 Torr of xenon as the buffer gas. When sufficient potential is established between electrodes 12*a* and 12*b* by power source 13, the xenon gas will provide electrons at starting. The production of MgH and visible light is the same as discussed in the previous embodiments.

While the invention has been described with reference to several exemplary embodiments, it is understood that the words which have been used herein are words of description and illustration, rather than words of limitations. Changes may be made, within the purview of the pending claims, without effecting the scope and spirit of the invention and its aspects. While the invention has been described here with reference to particular means, materials and embodiments, the invention is not intended to be limited to the particular disclosed herein; rather, the invention extends to all functionally equivalent structures, methods and uses, such as fall within the scope of the appended claims.

By way of non-limiting example, although the preferred buffer gas for the fill is argon or xenon, any appropriate buffer gas which provides electrons, and particularly any noble gas, may be used. The ratios of hydrogen/deuterium preferably remains in the 5–20% total pressure range regardless of the buffer gas selected, although values outside this range may prove acceptable based upon the various combinations of materials in the fill provided that the molecules of metal, hydrogen, and deuterium are the source of the majority of emitted light.

In another example, power supply 3 is set to 13.56 MHZ to facilitate fill discharge in the preferred embodiment. However, any appropriate frequency which generates an electric field in chamber 1 which induces discharge may be used.

In yet another example, the present invention is not limited to electrode and electrodeless lamps. Any environment which imparts energy into the fill to facilitate the chemical reactions described herein also fall within the scope and spirit of the invention. One such example is a lamp which transmits microwave energy into the chamber.

In still yet another example, although chamber 1 and 11 are preferably completely light transmissive, the invention is not so limited; and chambers having only a portion thereof which is light transmissive may be used.

In a further example, the sizes of chambers 1 and 11 are not limited to the dimensions described herein. Any appropriate size may be used provided that the fill components are within the parameters discussed herein.

What is claimed:

1. A fill adapted to produce light when energy is imparted thereto, comprising:

at least one metal;

at least one of hydrogen and deuterium; and at least one buffer gas having a density less than or equal to $1.0\times10_{19}$ atoms/cm$^3$.

2. The fill of claim 1, wherein said at least one metal includes an alkaline metal.

3. The fill of claim 1, wherein said at least one metal comprises at least one of magnesium, calcium, barium, and strontium.

4. The fill of claim 3, wherein said at least one metal additionally comprises at least one of sodium, lithium, indium, cadmium, and mercury.

5. The fill of claim 1, wherein said at least one buffer gas comprises at least one noble gas.

6. The fill of claim 5, wherein said at least one noble gas comprises at least one of xenon and argon.

7. The fill of claim 1, wherein a ratio of a pressure of said at least one of hydrogen and deuterium to a total pressure of said at least one of hydrogen and deuterium and said at least one buffer gas is between 5–20% at 25° C.

8. The fill of claim 1, wherein said at least one metal is present in an amount sufficient to create a vapor density in said fill between $10_{14}$ and $10_{16}$ atoms/cm$^3$ when vaporized.

9. The fill of claim 8, wherein said amount of said at least one metal produces a vapor density in said fill of approximately $10_{15}$ atoms/cm$^3$ when vaporized.

10. A lamp, comprising:

a sealed chamber, at least a portion of said chamber having a light transmissive surface; and a fill in said chamber, said fill comprising:

at least one metal;

at least one of hydrogen and deuterium; and at least one buffer gas having a density of less than or equal to $1.0\times10_{19}$ atoms/cm$^3$.

11. The lamp of claim 10, wherein at least a portion of said chamber is made of sapphire.

12. The lamp of claim 10, wherein at least a portion of said chamber is made of ceramic.

13. The lamp of claim 10, wherein at least a portion of said chamber is made of ceramic and a protective layer which isolates said at least one metal from said ceramic.

14. The lamp of claim 10, further comprising a device which transmits energy to said fill.

15. The lamp of claim 14, further comprising a power source connected to said device.

16. The lamp of claim 14, wherein said device is a coil in proximity to said chamber, such that said coil will generate an electromagnetic field sufficient to facilitate discharge of said fill when electricity is passed through said coil.

17. The lamp of claim 16, wherein said coil is made of one of at least one of silver, copper, and aluminum.

18. The lamp of claim 14, wherein said device comprises first and second electrodes mounted in said chamber.

19. The lamp of claim 10, wherein said at least one metal includes an alkaline metal.

20. The lamp of claim 10, wherein said at least one metal includes at least one of magnesium, calcium, barium, and strontium.

21. The lamp of claim 10, wherein a ratio of a pressure of said at least one of hydrogen and deuterium to the total gas pressure in said chamber is between 5–20% at 25° C.

22. The lamp of claim 10, wherein said at least one metal is present in an amount sufficient to create a vapor density of between $10_{14}$ and $10_{16}$ atoms/cm$^3$ in said chamber when said metal is vaporized.

23. The lamp of claim 22, wherein said amount of said at least one metal produces a vapor density of approximately $10_{15}$ atoms/cm$^3$ when said at least one metal is vaporized.

24. The lamp of claim 10, wherein a total pressure in said chamber at approximately 25° C. is approximately 2.0 Torr, and a pressure of said at least one of hydrogen and deuterium is approximately one of 0.2 and 0.4 Torr.

* * * * *